US009732611B2

(12) United States Patent
Zhang

(10) Patent No.: US 9,732,611 B2
(45) Date of Patent: Aug. 15, 2017

(54) METHOD AND APPARATUS FOR FORMATION TESTING AND SAMPLING WHEN PERFORMING SUBTERRANEAN OPERATIONS

(75) Inventor: Lizheng Zhang, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 165 days.

(21) Appl. No.: 14/384,991

(22) PCT Filed: Mar. 29, 2012

(86) PCT No.: PCT/US2012/031186

§ 371 (c)(1),
(2), (4) Date: Sep. 12, 2014

(87) PCT Pub. No.: WO2013/147790

PCT Pub. Date: Oct. 3, 2013

(65) Prior Publication Data

US 2015/0027216 A1 Jan. 29, 2015

(51) Int. Cl.

| | |
|---|---|
| ***E21B 49/10*** | (2006.01) |
| ***E21B 47/01*** | (2012.01) |
| ***E21B 47/09*** | (2012.01) |
| ***E21B 49/00*** | (2006.01) |

(52) U.S. Cl.

CPC ..... *E21B 49/10* (2013.01); *E21B 47/011* (2013.01); *E21B 47/09* (2013.01); *E21B 49/005* (2013.01)

(58) Field of Classification Search

CPC ..... E21B 47/011; E21B 49/005; E21B 49/10
USPC ..... 73/152.17, 152.26
See application file for complete search history.

(56) References Cited

U.S. PATENT DOCUMENTS

| | | | | |
|---|---|---|---|---|
| 3,934,468 | A | 1/1976 | Brieger | |
| 4,287,946 | A | 9/1981 | Brieger | |
| 4,860,581 | A | 8/1989 | Zimmerman et al. | |
| 4,879,900 | A | 11/1989 | Gilbert | |
| 6,301,959 | B1 | 10/2001 | Hrametz | |
| 6,658,930 | B2 | 12/2003 | Abbas | |
| 7,204,309 | B2 | 4/2007 | Segura | |
| 7,603,897 | B2 | 10/2009 | Gilbert | |
| 9,200,503 | B2 * | 12/2015 | Irani | E21B 49/10 |
| 2003/0145652 | A1 * | 8/2003 | Arian | E21B 49/10 73/152.26 |

(Continued)

FOREIGN PATENT DOCUMENTS

| | | |
|---|---|---|
| GB | 1209948 A | 10/1970 |
| WO | 03/097999 A1 | 11/2003 |

OTHER PUBLICATIONS

International Search Report issued in related PCT Application No. PCT/US2012/031186 mailed Feb. 4, 2013, 16 pages.

*Primary Examiner* — Benjamin Schmitt
(74) *Attorney, Agent, or Firm* — Benjamin Fite; Baker Botts L.L.P.

(57) ABSTRACT

Methods and systems for improving operations of a formation tester are disclosed. The formation tester (400) is placed in a wellbore at a location of interest. The formation tester comprises a first isolation pad (402) coupled to a pad carrier (410) and a second isolation pad (404). The first isolation is extendable to substantially seal a probe of the formation tester against a wellbore wall. The first isolation pad is then replaced with the second isolation pad if it is determined that the first isolation pad should be replaced with the second isolation pad.

20 Claims, 8 Drawing Sheets

(56) References Cited

U.S. PATENT DOCUMENTS

| | | | | |
|---|---|---|---|---|
| 2004/0173351 | A1 | 9/2004 | Fox et al. | |
| 2005/0109538 | A1* | 5/2005 | Fisseler | E21B 17/1078 175/20 |
| 2006/0065394 | A1* | 3/2006 | Clark | G01V 3/30 166/254.2 |
| 2008/0115575 | A1* | 5/2008 | Meek | E21B 17/10 73/152.24 |

* cited by examiner

METHOD AND APPARATUS FOR FORMATION TESTING AND SAMPLING WHEN PERFORMING SUBTERRANEAN OPERATIONS

CROSS-REFERENCE TO RELATED APPLICATION

This application is a U.S. National Stage Application of International Application No. PCT/US2012/031186 filed Mar. 29, 2012, which is hereby incorporated by reference in its entirety.

BACKGROUND

Hydrocarbons, such as oil and gas, are commonly obtained from subterranean formations. The development of subterranean operations and the processes involved in removing hydrocarbons from a subterranean formation are complex. Typically, subterranean operations involve a number of different steps such as, for example, drilling the wellbore at a desired well site, treating the wellbore to optimize production of hydrocarbons, and performing the necessary steps to produce and process the hydrocarbons from the subterranean formation.

When performing subterranean operations, it is often necessary to engage in ancillary operations, such as monitoring the operability of equipment used to perform drilling operations or evaluating the production capabilities of the formation. For instance, it is often desirable to obtain information regarding the formation and/or the fluids therein such as pressure, permeability and composition. The obtained data may then be used to optimize the performance of the subterranean operations. For instance, the data may be used to determine the location and quality of hydrocarbon reserves, whether hydrocarbon reserves can be produced through the wellbore, and for well control during drilling operations. The formation data may be obtained using formation testing tools. The formation testing tools may be used as components of a logging-while-drilling ("LWD") or measurement-while-drilling ("MWD") package.

In order to understand the formation testing process, it is important to understand how hydrocarbons are stored in subterranean formations. Typically, hydrocarbons are stored in small holes, or pores, within the subterranean formation. The ability of a formation to allow hydrocarbons to flow between pores and consequently, into a wellbore, is referred to as permeability. Additionally, hydrocarbons contained within a formation are typically stored under pressure. It is therefore beneficial to determine the magnitude of that pressure in order to safely and efficiently produce from the well.

A drilling fluid ("mud") is typically injected into a wellbore when performing drilling operations. The mud may be water, a water-based mud or an oil-based mud. In some applications, special solids may be suspended in the mud to increase the mud's density. The increase in mud density increases the hydrostatic pressure that helps maintain the integrity of the wellbore and prevents unwanted formation fluids from entering the wellbore. As the mud is circulated in and out of the wellbore during drilling operations, the solids in the mud may be deposited on an inner wall of the wellbore forming a "mudcake." The thickness of the mudcake may be dependent on the time the borehole is exposed to the drilling fluid.

The mudcake acts as a membrane between the wellbore which is filled with drilling fluid and the hydrocarbon formation. Additionally, the mudcake may hinder the migration of drilling fluids from an area of high hydrostatic pressure in the wellbore to the relatively low-pressure formation.

FIG. 1 depicts the structure and operation of a typical formation tester in accordance with the prior art. In a typical formation testing operation, a wellbore 102 is filled with wellbore fluid or "mud" 104, and the wall of wellbore 102 is coated with a mudcake 106. A formation tester 100 is lowered to a desired depth within the wellbore 102. Once the formation tester 100 is at the desired depth, it is set in place by extending a pair of feet 108 and an isolation pad 110 to engage the mudcake 106. The isolation pad 110 substantially seals against the mudcake 106 and around a probe 112, which places an internal cavity 119 in fluid communication with a formation 122. This creates a fluid pathway that allows formation fluid to flow between the formation 122 and the formation tester 100 while isolated from the wellbore fluid 104.

In order to acquire a useful sample, the probe 112 must stay isolated from the relative high pressure of the wellbore fluid 104. Therefore, the integrity of the seal that is formed by the isolation pad 110 is critical to the performance of the formation tester 100. If the wellbore fluid 104 is allowed to leak into the collected formation fluids, a non-representative sample will be obtained and the test might have to be repeated.

Isolation pads are typically made of rubber and are molded to fit the specific diameter hole in which they will be operating. However, the isolation pads are typically subject to wear and tear. As a result, over time, the sealing capability of the isolation pad is typically compromised, forcing an operator to use valuable rig time to remove the formation tester from the wellbore and replace or repair the isolation pad. Moreover, once the isolation pad is replaced or repaired, the operator typically has to utilize resources to return the formation tester to the location of the sampling where testing was interrupted due to damage to the isolation pad in order to resume testing.

Figure 1:
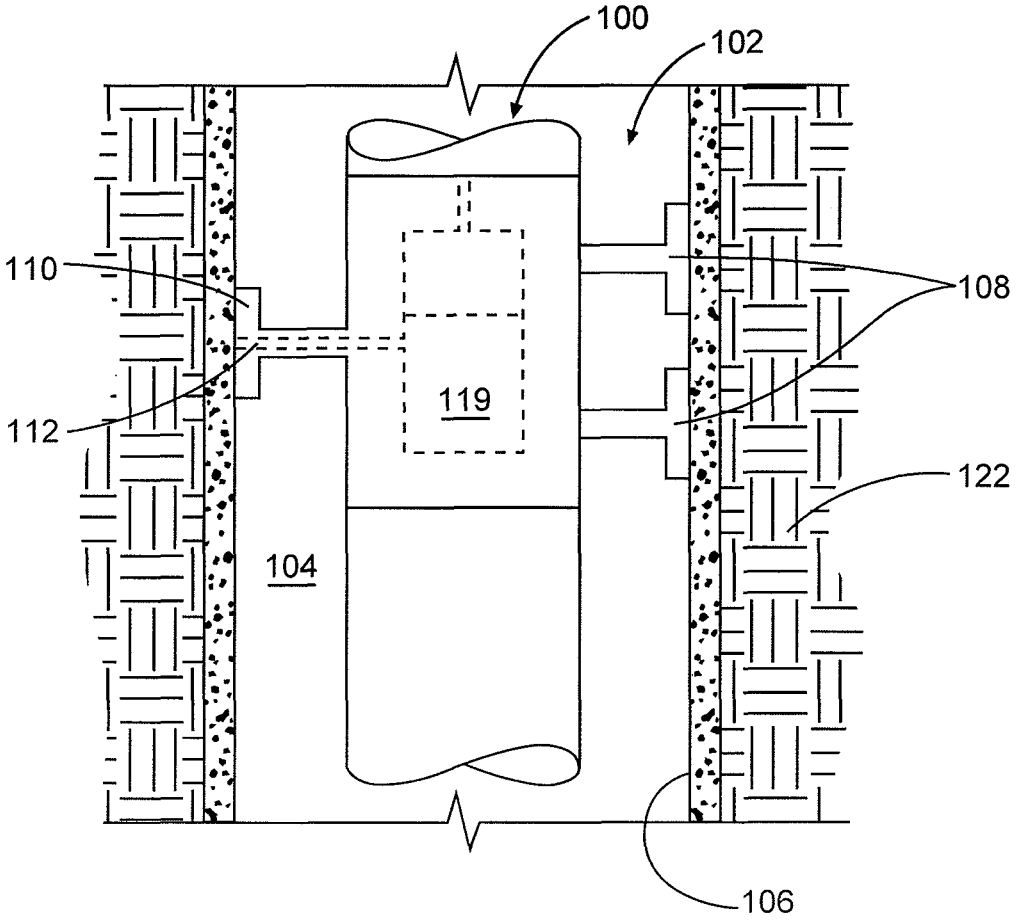
FIG. 1 is a formation testing tool in accordance with the prior art.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline, MWD and LWD operations.

The terms "couple" or "couples" as used herein are intended to mean either an indirect or direct connection. Thus, if a first device couples to a second device, that connection may be through a direct connection, or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

The present application is directed to improving efficiency of subterranean operations and more specifically, to a method and system for improving operations of a formation tester.

Figure 2:
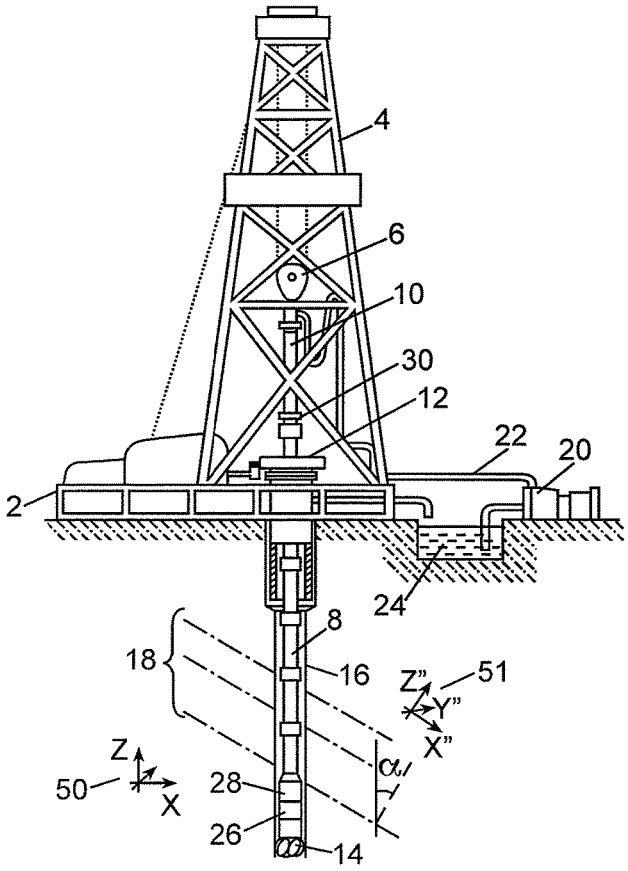
FIG. 2 shows an illustrative logging while drilling or measurement while drilling environment.

Turning now to FIG. 2, oil well drilling equipment used in an illustrative LWD and/or MWD environment is shown. A drilling platform 2 supports a derrick 4 having a traveling block 6 for raising and lowering a drill string 8. A kelly 10 supports the drill string 8 as it is lowered through a rotary table 12. A drill bit 14 is driven by a downhole motor and/or rotation of the drill string 8. As bit 14 rotates, it creates a borehole 16 that passes through various formations 18. A pump 20 may circulate drilling fluid through a feed pipe 22 to kelly 10, downhole through the interior of drill string 8, through orifices in drill bit 14, back to the surface via an annulus around drill string 8, and into a retention pit 24. The drilling fluid transports cuttings from the borehole 16 into the pit 24 and aids in maintaining integrity of the borehole 16.

A tool 26 may be integrated into the bottom-hole assembly near the bit 14. The tool 26 may be a logging tool and/or a measuring tool. The tool 26 may include receivers and transmitters. In one embodiment, the tool 26 may include a transceiver array that functions as both a transmitter and a receiver. As the bit 14 extends the borehole 16 through the formation 18, the tool 26 may collect measurements relating to various formation properties as well as tool orientation and position and various other drilling conditions. The orientation measurements may be performed using an azimuthal orientation indicator, which may include magnetometers, inclinometers, and/or accelerometers, though other sensor types such as gyroscopes may be used in some embodiments. The logging tool 26 may take the form of a drill collar, i.e., a thick-walled tubular that provides weight and rigidity to aid the drilling process. A telemetry sub 28 may be included to transfer tool measurements to a surface receiver 30 and to receive commands from the surface receiver 30.

Figure 3:
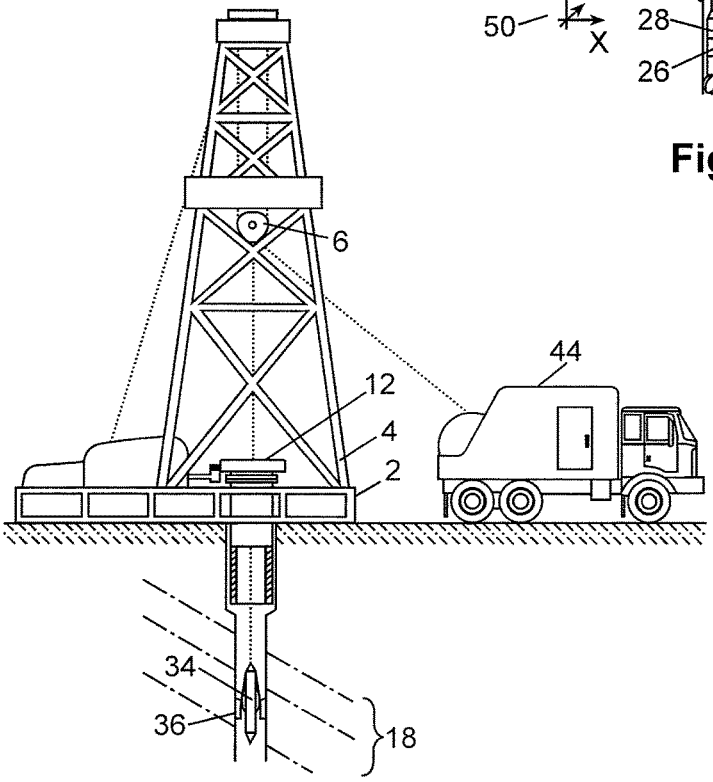
FIG. 3 shows an illustrative wireline logging environment.

At various times during the drilling process, the drill string 8 may be removed from the borehole as shown in FIG. 3. Once the drill string has been removed, logging operations can be conducted using a wireline logging tool 34, i.e., a sensing instrument sonde suspended by a cable having conductors for transporting power to the tool 34 and telemetry from the tool 34 to the surface. A logging facility 44 may collect measurements from the logging tool 34, and may include computing facilities for processing and storing the measurements gathered by the logging tool 34.

Figure 4:
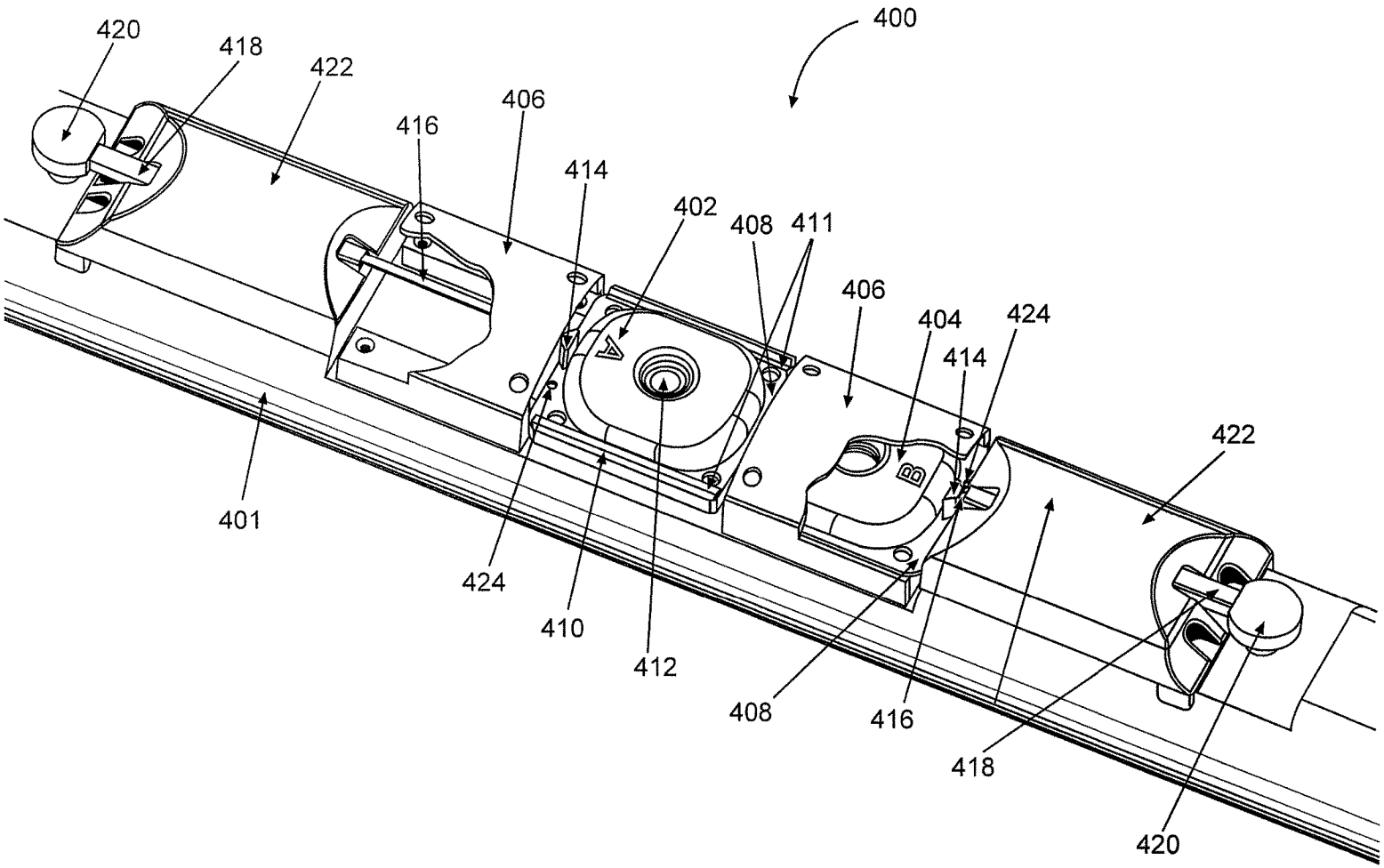
FIG. 4 shows a formation tester in accordance with an exemplary embodiment of the present invention with a primary isolation pad in the retracted position.

FIG. 4 depicts a portion of a formation tester in accordance with an embodiment of the present disclosure denoted generally with reference numeral 400. In one exemplary embodiment, the formation tester 400 may include a first isolation pad 402 and a second isolation pad 404. In one embodiment, the two isolation pads 402, 404 may be substantially identical, so that one will serve as a backup for the other. In one embodiment, the pads 402, 404 may be made of different rubber materials while sharing the same or common metal base 408. In certain embodiments, the pads 402, 404 may be made of different rubber compounds or be of different hardness. A protective guard 406 may be provided to house each of the isolation pads 402, 404 when they are not being used to perform sampling operations. Accordingly, the protective guards 406 may provide a storage location for the isolation pads 402, 404 and may substantially cover the isolation pads 402, 404 when in the storage location.

Turning back to FIG. 4, in accordance with certain embodiments, one of the first isolation pad 402 and the second isolation pad 404 may be chosen over the other when performing formation testing to adapt to specific wellbore conditions at a certain zone to achieve optimum sealing performance. Although the first isolation pad 402 and the second isolation pad 404 are depicted as having the same shape in FIG. 4, as would be appreciated by those of ordinary skill in the art, the two pads may have shapes that differ. Moreover, in one embodiment, the size of each specific pad may be designed to be best suited for a particular range of borehole sizes. For example, a pad with a 4.25" cylindrical radius may be used for borehole sizes ranging from approximately 8" to approximately 9" in diameter; a pad with a 6.13" cylindrical radius may be used for borehole sizes of approximately 12" in diameter; and a pad with a 8.75" cylindrical radius may be used for borehole sizes approximately 17" in diameter.

If the first isolation pad 402 and the second isolation pad 404 are of different radii, either one may be selected during sampling depending on the borehole size at the location of interest. In one embodiment, once the borehole size at a location of interest is known, the radius of the first isolation pad and the radius of the second isolation pad may be compared with the radius of the isolation pad best suited for the borehole size at the particular location of interest. The selection of the isolation pad best suited for a particular application may be based on data from prior experiences or it may be based on trial and error. Specifically, in certain embodiments, the information regarding the radius of the isolation pad that is best suited for a particular borehole size may be stored in a computer-readable medium setting forth the optimal isolation pad radius for each borehole size. This information may then be used to determine which of the first isolation pad and the second isolation pad has a radius that is closest to the optimal isolation pad radius for the borehole size at the location of the interest. Whichever of the first isolation pad and the second isolation pad has a radius that is closest to the optimal radius will be identified as the better match for sampling at the location of interest and may be utilized to form a seal. Although the isolation pads may have a wide range of radii to cover various borehole sizes, the isolation pads usually have the same footprint and can use the same metal base. Accordingly, it is determined whether the radius of the first isolation pad or the radius of the second isolation pad is best suited for the borehole size at the sampling location. The isolation pad that is best suited for the particular sampling location is then utilized.

Moreover, if it is determined that one of the pads 402, 404 cannot establish a proper seal at a certain location, the other may be tried out. By having a second isolation pad 404 that is readily available to replace the first isolation pad 402, the sampling operations may be performed more efficiently. Specifically, because the formation tester 400 need not be removed to the surface to replace the first isolation pad 402 with a second isolation pad 404 the sampling operations may be optimized and the costs associated with the sampling operations may be reduced. Accordingly, the methods and systems disclosed herein are not limited to instances when one of the pads 402, 404 is damaged and needs to be replaced. The present methods and systems are also applicable in instances where the shape and/or size of one of the pads 402 or 404 is preferred over the other for testing at a particular location. In such instances, because both pads 402, 404 are readily available (as discussed in more detail below), the formation tester 400 can utilize the pad 402, 404 that is best suited for the particular location.

Although two pads (402 and 404) are shown in the embodiment of FIG. 4, as would be appreciated by those of ordinary skill in the art, with the benefit of this disclosure, more pads may be used. Specifically, additional backup isolation pads may be used to prolong the period the formation tester 400 may remain downhole without having to return to surface to replace an isolation pad.

The term "active pad" as used herein refers to the isolation pad that is positioned to be utilized by the formation tester and the term "backup pad" refers to the isolation pad that is kept as a backup, but not currently being used. Accordingly, at any given time, the formation tester 400 may include one active pad and one or more backup pads. In the exemplary embodiment of FIG. 4, the first isolation pad 402 is the active pad. In accordance with an embodiment of the present disclosure, the active pad (402 in FIG. 4) may be positioned on a pad carrier 410. The pad carrier 410 may sit on the tool body 401. In one embodiment, the pad carrier 410 is radially movable relative to the tool body 401. Specifically, the pad carrier 410 may move radially back and forth relative to the tool body 401 by moving into or out of the tool body 401 along an axis substantially normal to a surface of the tool body 401. As would be appreciated by those of ordinary skill in the art, with the benefit of this disclosure, any suitable mechanism may be used to move the pad carrier 410 radially back and forth relative to the tool body 401. In one embodiment, the pad carrier 410 may be driven back and forth by a hydraulic ram (not shown). In one embodiment, the pad carrier 410 may constrain movement of the active pad 402 in all but one direction. Specifically, the pad carrier 410 may include one or more sliding grooves 411 on each side which engage the active pad 402. The active pad 402 may then slide along the grooves 411 in a direction along the axis of the tool body 401 as shown in FIG. 4.

Figure 4A:
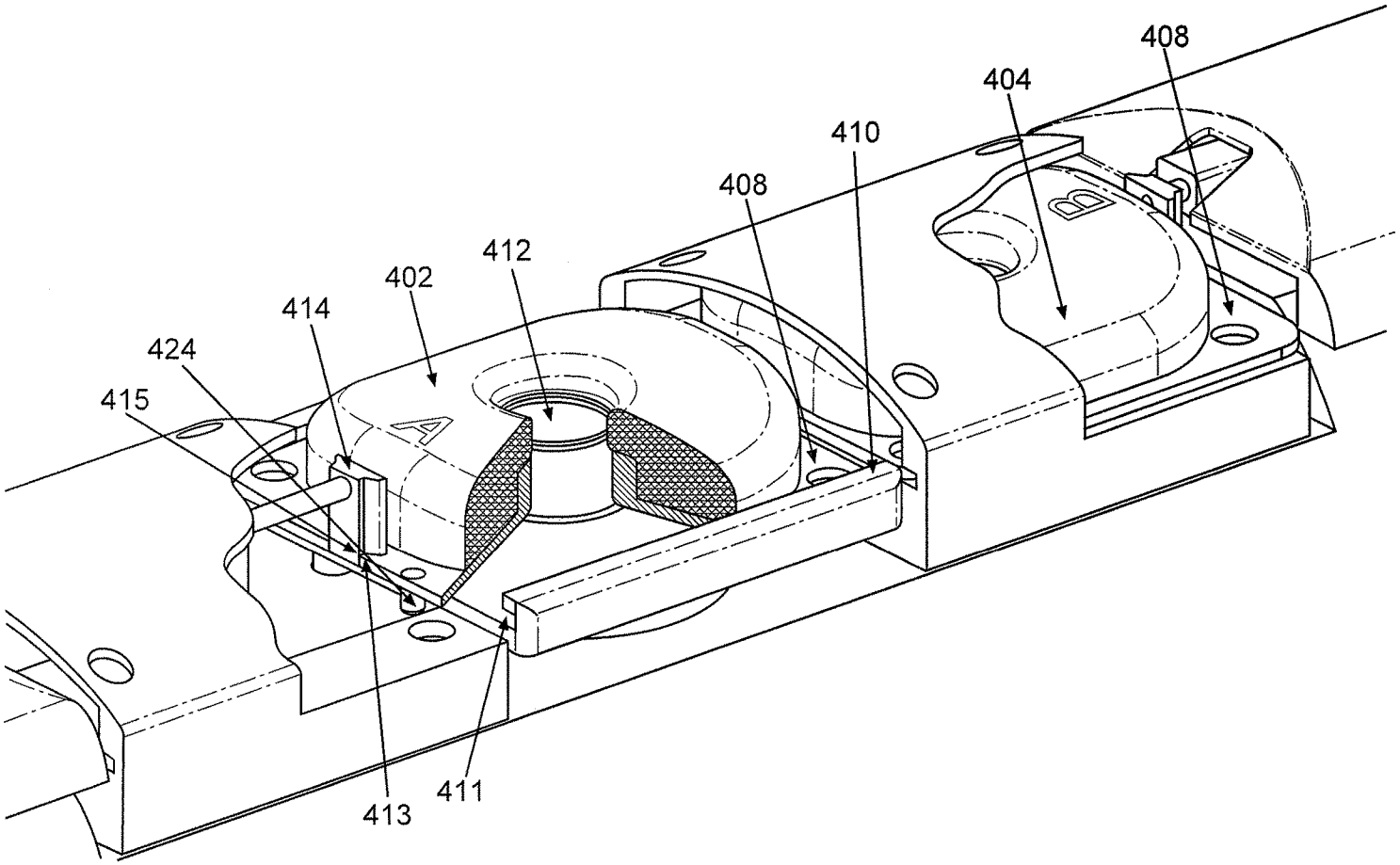
FIG. 4A shows a close up view of the active pad of FIG. 4 in the retracted position, with a portion of the active pad cut out to show the probe engaging the active pad.

The formation tester 400 may further include a probe 412. The probe 412 provides a path for the fluid to flow from the formation into the tool body 401. Accordingly, the probe 412 may extend and retract with the active pad (402 in FIG. 4) and the pad carrier 410. In the extended position (as shown in FIGS. 5 and/or 7), the active pad (402 in FIG. 5 and 404 in FIG. 7) may seal against a wall of the wellbore to facilitate the sampling operations. In one embodiment, the probe 412 may have two positions relative to the pad carrier 410 or the hydraulic ram as shown in more detail in FIGS. 4A and 4B. First, at its default position, the probe 412 may stick into an opening in the active pad 402 as shown in FIG. 4A, allowing the active pad 402 to move radially back and forth with respect to the tool body 401 along with the pad carrier 410 during setting or retracting operations. However, the probe 412 may constrain the remaining degrees of freedom of the active pad 402, not permitting the active pad 402 to slide along the tool body 401.

When the active pad 402 is to be changed, it is retracted along with the pad carrier 410 by the hydraulic ram. As would be appreciated by those of ordinary skill in the art, with the benefit of this disclosure, in one embodiment, the hydraulic ram may be driven by activation and deactivation of solenoid valves. The use of solenoid valves to activate/deactivate a hydraulic ram is well known to those of ordinary skill in the art and will therefore not be discussed in detail herein.

Figure 4B:
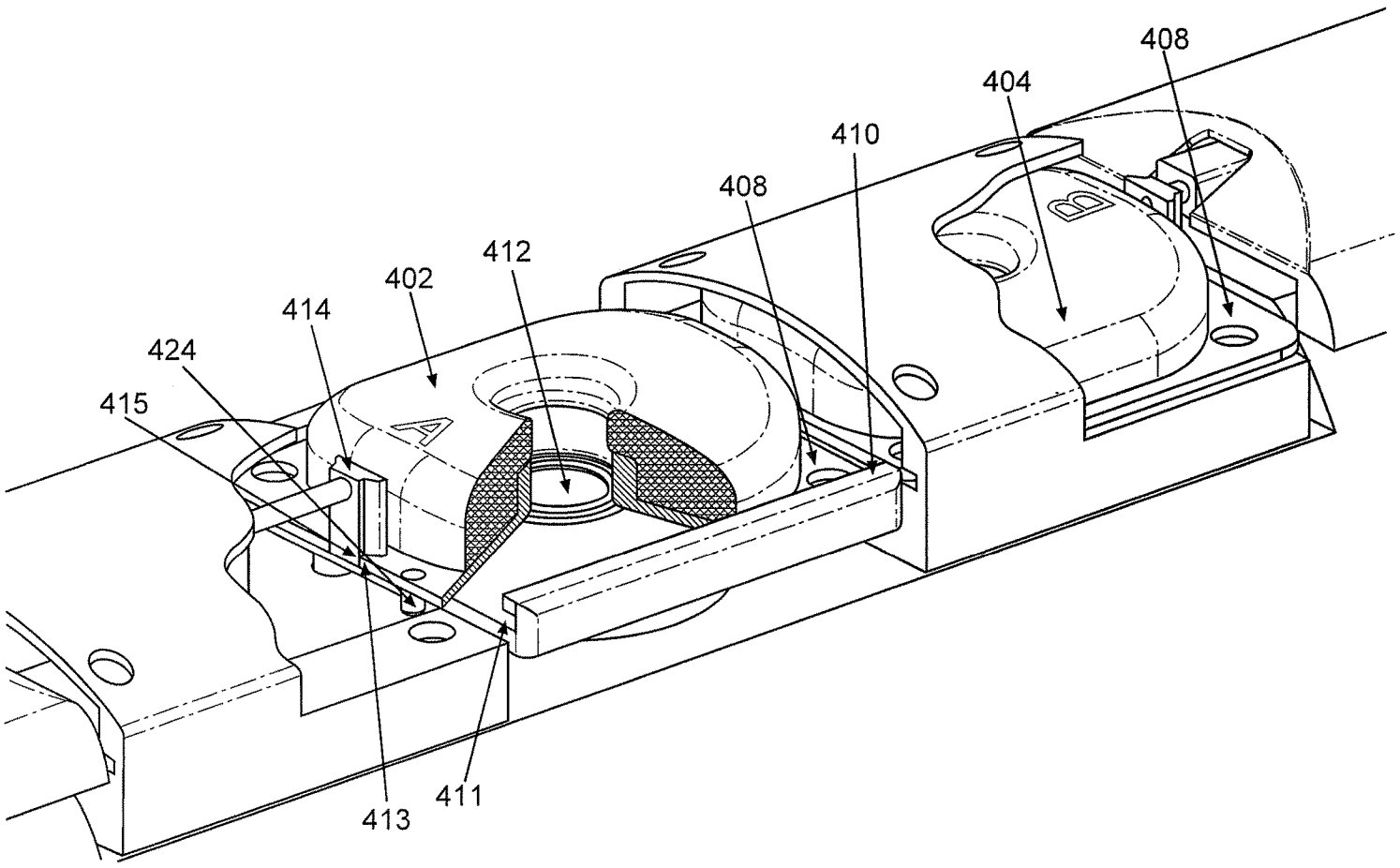
FIG. 4B shows a close up view of the active pad of FIG. 4 in the retracted position, with a portion of the active pad cut out to show the probe disengaged from the active pad.
Figure 5:
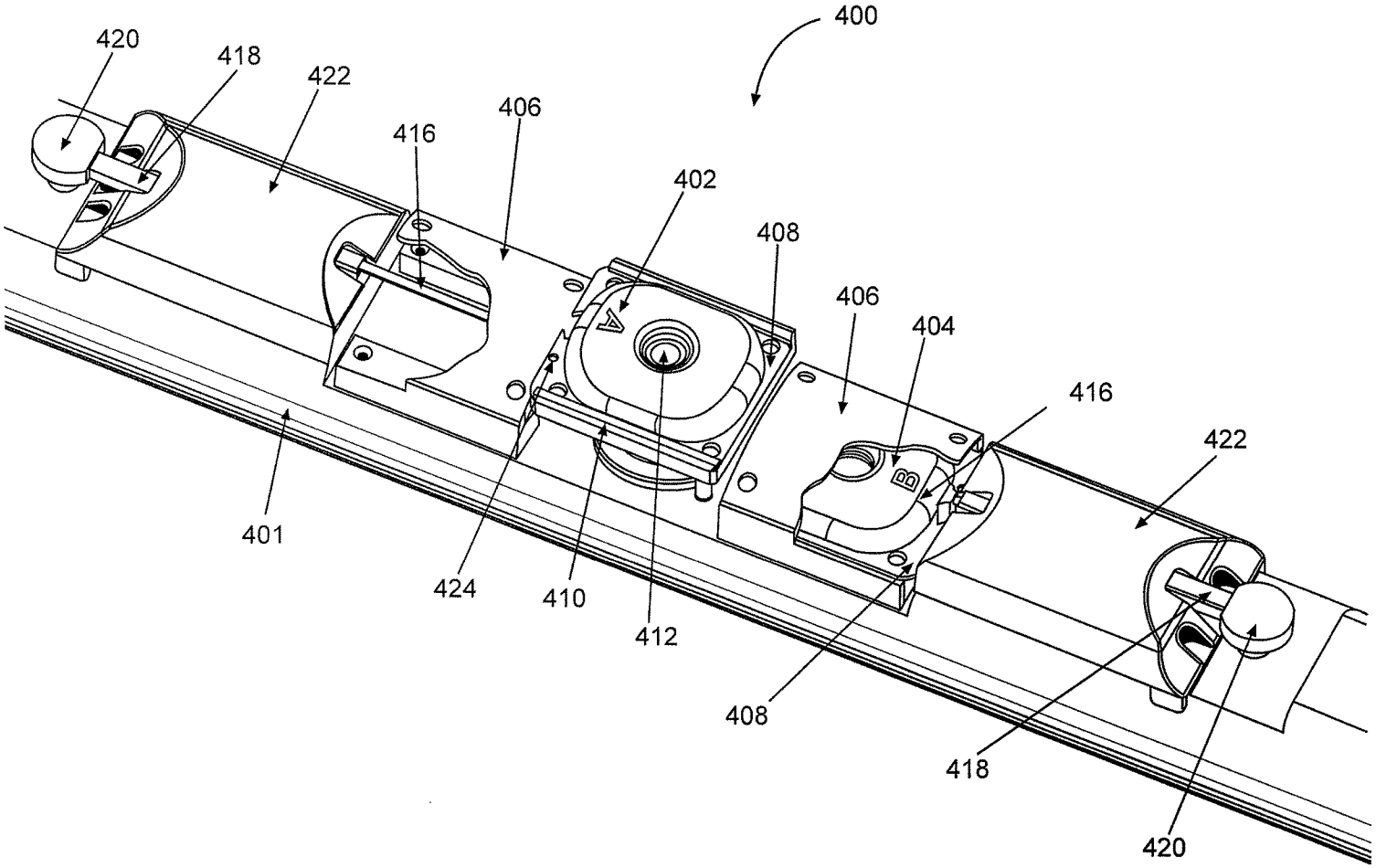
FIG. 5 shows a formation tester in accordance with an exemplary embodiment of the present invention with a primary isolation pad in the extended position.

Once the active pad 402 is fully retracted, another hydraulic pressure is applied to the probe 412, moving it away from its default position relative to the pad carrier 410 as shown in FIG. 4B. Specifically, the probe 412 may be moved into a "pad changing" position. In the pad changing position, the probe 412 moves further downward and is decoupled from the active pad 402. In one embodiment, the probe 412 may be moved downward until it no longer sticks into the opening in the active pad 402. Once the probe 412 is decoupled from the active pad 402, the active pad 402 may slide relative to the pad carrier 410. While the active pad 402 and/or pad carrier 410 are being retracted, a coupling mechanism 413 at the metal base 408 of the active pad 402 may engage with the linear actuator adapter 414. In one embodiment, the coupling mechanism 413 may be a dovetail slot, a T-slot, or any other suitable coupling mechanism. The coupling mechanism 413 at the metal base 408 of the active pad 402 may engage a corresponding coupling mechanism 415 at the linear actuator adapter 414. For instance, in one embodiment, the linear actuator adapter 414 may include a coupling mechanism 415 which is a dovetail pin that fits into a coupling mechanism 413 which is a dovetail slot on the metal base 408 of the active pad 402 as shown in FIGS. 4A and 4B. The linear actuator adapter 414 may be driven by a liner motion actuator. In accordance with certain embodiments, the linear motion actuator may be composed of a piston rod 416 and a piston housing 418. In one embodiment, the piston rod 416 may be driven hydraulically and the hydraulic power may be provided by the formation tester 400 through one or more solenoid valves. A hydraulic adapter 420 may connect the two hydraulic lines coming out of the piston and direct them into the tool body 401, where they may join the respective hydraulic lines in the formation tester 400.

In certain embodiments, as shown in more detail in FIGS. 4A and 4B, a position limiting pin 424 may be positioned on the metal base 408 of the pads 402, 404 to stop axial movement of a pad when it reaches the pad changing position, where the pin 424 is stopped by the pad carrier 410. The position limiting pin 424, together with the linear actuator adapter 414, may place the pad precisely at the pad changing position.

FIG. 5 depicts the formation tester 400 of FIG. 4 with the first isolation pad 402 in the extended position as the active pad. In operation, the surface of the isolation pad 402 would provide a seal against the formation when the isolation pad 402 is extended as shown in FIG. 5. The seal provided by the isolation pad 402 may facilitate removal of samples from the formation as discussed above in conjunction with FIG. 1.

Figure 6:
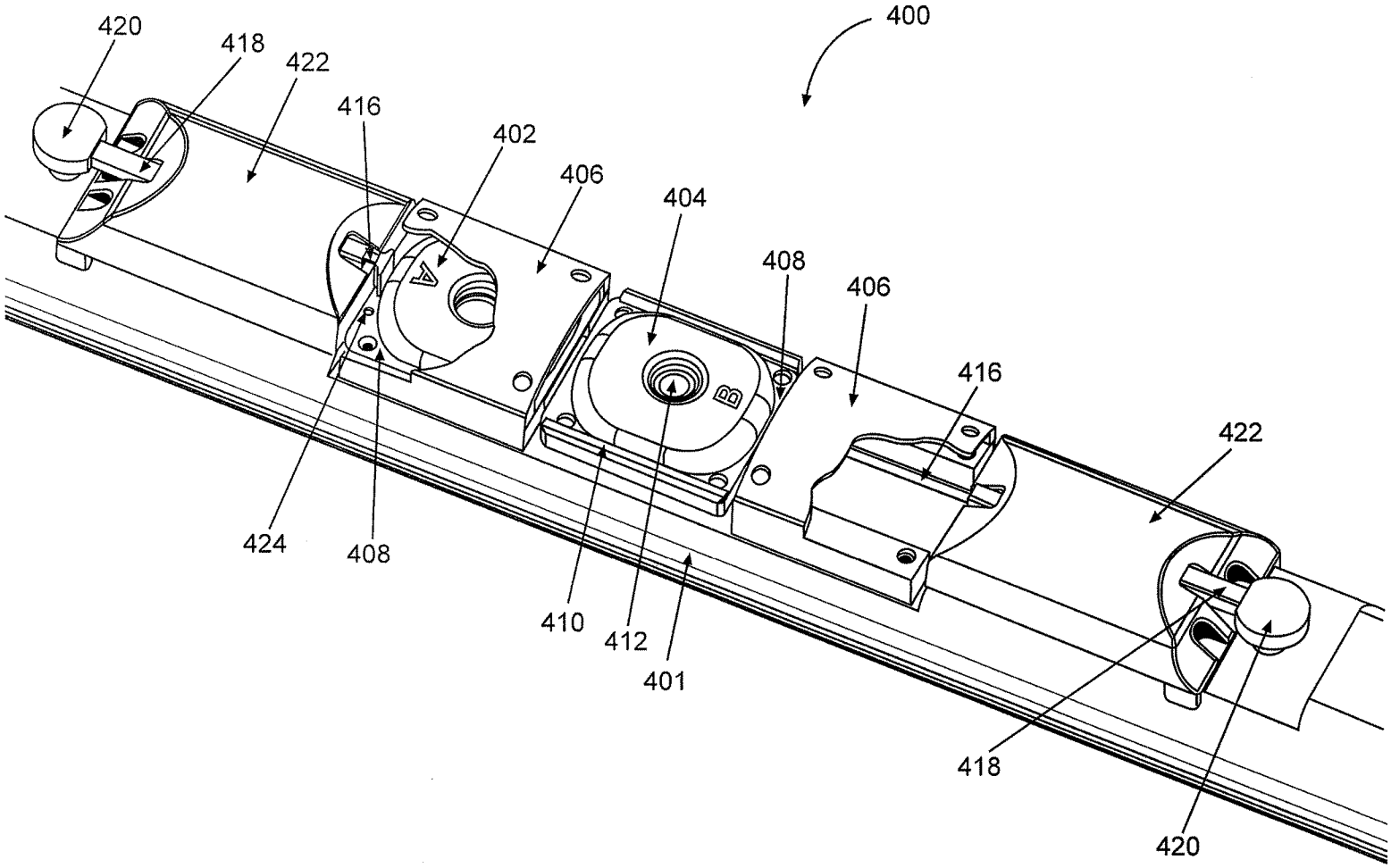
FIG. 6 shows a formation tester in accordance with an exemplary embodiment of the present invention with a backup isolation pad in the retracted position.

Turning now to FIG. 6, when the active pad 402 is retracted, engaged with linear actuator adapter 414, and disengaged with the probe 412 as mentioned above, the pad is ready to be changed. The piston rod 416 may then retract (as shown in FIG. 6), pulling the active pad 402 into the protective guard 406. Specifically, each of the isolation pads 402, 404 may be placed inside the storage location provided by the protective guard 406 when they are detached from the pad carrier 410. In the exemplary embodiment of FIGS. 6 and 7, the protective guards 406 are depicted with a partial cutout view. To minimize the number of solenoid valves required, the two linear actuators (piston rods 416 and piston housings 418 on both sides of the pads) may be controlled by the same valves and work in unison. Specifically, while the piston rod 416 on a first side is retracted, the piston rod 416 on a second and opposing side of the pads 402, 404 may be extended simultaneously, pushing the second isolation pad 404 into place. Accordingly, now the second isolation pad 404, which was the backup pad, becomes the active pad. The probe 412 again moves into its default position, engaging the active pad (now pad 404), constraining its sliding degree of freedom. It should be noted that once the pad 404 completely slides out of the protective guard 406, and engages with the probe 412, it is fully constrained to the pad carrier 410. The linear actuator adapter 414 may include a dovetail shape that engages with the dovetail shaped slot on the metal base 408 of the respective pads 402 and 404, as shown in FIGS. 4, 4A and 4B. The dovetail adapter 414 on the right side piston rod 416, although still being engaged with the pad base 408, allows the pad to be extended or retracted (free to move radially back and forth, as described above). As discussed above, although a dovetail adapter is shown, other coupling mechanisms known to those of ordinary skill in the art may be used without departing from the scope of the present disclosure.

Figure 7:
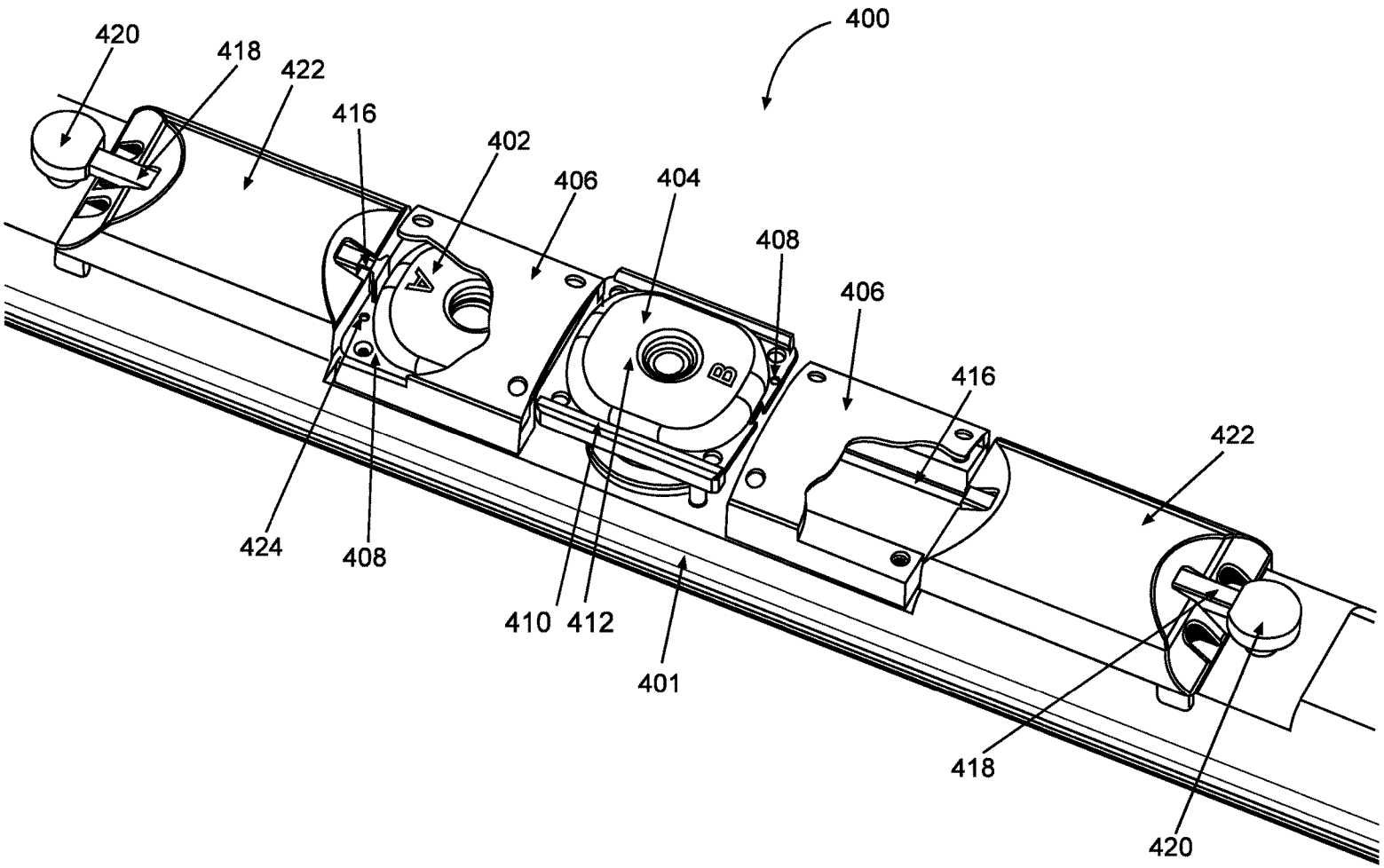
FIG. 7 shows a formation tester in accordance with an exemplary embodiment of the present invention with a backup isolation pad in the extended position.

Once the second isolation pad 404 is positioned on the pad carrier 410, it may be extended as shown in FIG. 7 and utilized to perform formation testing in the same manner as the first isolation pad 402.

The protective guards 406 may be attached to the tool body 401 by any suitable means. In one embodiment, the protective guards 406 may be detachably coupled to the tool body 401 by fasteners. The protective guards 406 may be designed so that the slots on both sides of each guard 406 serve as sliding guides for the corresponding isolation pad. In this manner, all degrees of freedom of the isolation pad are constrained by the guard 406 except the degree of freedom in the direction along the tool body 401 axis. Consequently, the isolation pads can slide freely along the slots in the guide 406. Additionally, the outer surface of the protective guards 406 may protect the isolation pad (402 or 404) stored at this location from wear while the formation tester 400 is running in or out of a wellbore. At any time, while being engaged with the linear actuator adapter 414, the pads 402, 404 may not move in the direction along the tool axis because this degree of freedom is constrained by the piston rod 416.

As shown in the figures and discussed above, both pads 402, 404 are fully constrained at all times. Specifically, at a given time, the pads 402, 404 may be constrained relative to the tool body 401, the pad carrier 410, or both. As a result, the pads 402, 404 will not be separated from the tool body 401 due to shock, vibration or other known and unknown external forces. Further, as discussed above, the position of the pads 402, 404 may be remotely controlled by controlling the probe 412 and the linear motion actuator (e.g., piston rod 416 and piston housing 418). In one embodiment, a user may utilize an information handling system to control the operation of the various components of the formation tester 400 such as the control valves, the solenoid valves, the linear motion actuator, the pad carrier 410 and/or the probe 412. Specifically, an information handling system may be communicatively coupled to the formation tester 400. A machine readable medium may be accessible to the information handling system with instructions necessary to perform the methods disclosed herein. The information handling system may then control the movement of the isolation pads (402, 404), the pad carrier 410 and/or the probe 412 as desired and selectively move each isolation pad to a desired location in the manner discussed above.

In certain embodiments, the linear actuators (piston rod 416 and piston housing 418 in this particular embodiment) may be designed to set the default position of the pads 402, 404 to be in the retracted position. Therefore, if the formation tester 400 loses power at any time or otherwise malfunctions, the active pad may be retracted and the inactive pad may be held in the protective guard 406 and not interfere with the position of the active pad.

In accordance with certain embodiments of the present disclosure, more than one control valve or solenoid may be used to control operation of the formation tester 400. When more control valves (or electronic switches if the actuators are driven electrically) are readily available, the two linear actuators may also work independently. When utilizing a plurality of control valves and/or solenoids, both linear actuators may be retracted at the same time, independent from one another, while the formation tester is running in or out of the hole. Accordingly, both isolation pads 402, 404 may be kept under the cover of the protective guards 406 as the device is moved from one location to another or when the device is not being used. This may minimize the likelihood and rate of pad wear when performing subterranean operations.

In accordance with certain embodiments (for instance, if space is limited), only one linear actuator 416 may be used to achieve similar results. In this case, the metal base 408 may still have one dovetail slot on one end, and an "L" shaped hook on the other end. For example, two isolation pads may be concatenated by the "L" shaped hooks on each pad, allowing them to move together in the axial direction while permitting independent movement in the radial direction relative to the tool body 401. The single linear actuator may push/pull the pad which it is directly engaged to, moving it to/from the storage and pad changing position. Since the pad is concatenated with the other pad, the other pad will also be pushed/pulled to and from its storage location and the pad changing position. In this case, another solenoid or any other retaining feature may be used to limit the axial movement of the pad that is not directly engaged with the linear actuator and becomes disengaged with the active pad when the active pad is extended. This solenoid may engage with this pad when it reaches its storage location (as discussed above) and may disengage with it when it is ready to be pulled out of its storage location.

The foregoing invention reduces the time and expense associated with replacing or servicing the isolation pad on the surface because the formation tester 400 need not be removed to the surface each time an isolation pad is damaged. Specifically, as sampling operations are performed, the isolation pads (402 and/or 404) may be damaged in a number of ways. For instance, cracks may develop in the rubber portion of the isolation pads or large portions of the isolation pad may be chewed off due to downhole temperature and the pressure differential. Once the isolation pad is damaged, it can no longer provide an effective seal leading to a loss of isolation and an inability to reestablish isolation. Using the methods and systems disclosed herein, once a loss of isolation is detected and it is determined that isolation cannot be reestablished, it is concluded that the active pad is damaged. The active pad may then be replaced with the back-up pad downhole without the need to remove the formation tester to the surface for repair.

Moreover, the availability of an alternate isolation pad optimizes the performance of sampling operations by allowing an operator to select the isolation pad that is best suited for the particular sampling location without having to remove the formation tester 400 to the surface. Because transfer of the formation tester between the surface and its downhole position consumes precious rig time and resources, the methods and systems disclosed herein optimize the performance of sampling operations.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A formation tester tool comprising:

a pad carrier coupled to a tool body, wherein the pad carrier is radially movable relative to the tool body;

a first isolation pad and a second isolation pad detachably coupled to the tool body, wherein each of the first isolation pad and the second isolation pad is axially movable along the tool body, and wherein the first isolation pad is retractable from an extended position such that the first isolation pad is replaceable by the second isolation pad while the formation tester tool is downhole; and a mechanism selectively coupling one of the first isolation pad and the second isolation pad to the pad carrier.

2. The formation tester tool of claim 1, wherein the first isolation pad is detachably coupled to the pad carrier by sliding into one or more grooves on the pad carrier.

3. The formation tester tool of claim 1, further comprising a probe, wherein the probe is operable to selectively engage and disengage at least one of the pad carrier and the first isolation pad.

4. The formation tester tool of claim 3, wherein the probe prevents axial movement of the first isolation pad along the tool body.

5. The formation tester tool of claim 1, wherein at least one of the first isolation pad and the second isolation pad is placed inside a protective guard.

6. The formation tester tool of claim 1, wherein the mechanism selectively coupling one of the first isolation pad and the second isolation pad to the pad carrier comprises a linear actuator adapter.

7. A formation testing device comprising:

a pad carrier coupled to a tool body of the formation testing device, wherein the pad carrier is radially movable relative to the tool body;

a probe sealable to a wall downhole, wherein the probe is detachably engageable with the pad carrier;

a first isolation pad detachably coupled to the pad carrier and engageable with the probe, wherein the first isolation pad selectively isolates the probe when obtaining formation samples;

a first protective guard, wherein the first protective guard substantially covers the first isolation pad when the first isolation pad is detached from the pad carrier; and a second isolation pad detachably couplable to the pad carrier, and wherein the first isolation pad is retractable from an extended position to disengage from the probe such that the first isolation pad is replaceable by the second isolation pad while the formation tester tool is downhole.

8. The formation testing device of claim 7, wherein the second isolation pad is placed into a second protective guard when it is detached from the pad carrier.

9. The formation testing device of claim 8, wherein at least one of a shape and a size of the first isolation pad is different from that of the second isolation pad.

10. The formation testing device of claim 8, wherein one of the first isolation pad and the second isolation pad may be selectively coupled to the pad carrier.

11. The formation testing device of claim 8, wherein the first isolation pad and the second isolation pad comprise a common metal base.

12. The formation testing device of claim 7, wherein the first isolation pad is detachably couplable to the pad carrier by sliding into one or more grooves on the pad carrier.

13. The formation testing device of claim 7, wherein the first protective guard is detachably coupled to the formation testing device.

14. A non-transitory machine readable medium accessible to an information handling system, the machine readable medium including instructions which enable the information handling system to:

place a formation tester in a wellbore at a location of interest, wherein the formation tester comprises a first isolation pad and a second isolation pad, wherein at least one of the first isolation pad and the second isolation pad is couplable to a pad carrier, wherein the pad carrier is radially movable relative to a tool body of the formation tester, and wherein the pad carrier is extendable to permit at least one of the first isolation pad and the second isolation pad to substantially seal a probe of the formation tester against a wall of the wellbore;

selectively couple one of the first isolation pad and the second isolation pad to the pad carrier;

extend the pad carrier, wherein one of the first isolation pad and the second isolation pad substantially seals the probe of the formation tester against the wall of the wellbore when the pad carrier extends;

retract the pad carrier;

slide the one of the first isolation pad and the second isolation pad relative to the pad carrier; and replace the one of the first isolation pad and the second isolation pad.

15. A method of performing formation testing comprising:

placing a formation tester in a wellbore at a location of interest, wherein the formation tester comprises a first isolation pad and a second isolation pad coupled to a tool body;

the formation tester comprises a pad carrier that is radially extendable from the tool body to substantially seal a probe of the formation tester against a wall of the wellbore; and the first isolation pad and the second isolation pad are selectively couplable to the pad carrier;

coupling the first isolation pad to the pad carrier;

engaging the first isolation pad with the probe;

performing a formation test; and replacing the first isolation pad with the second isolation pad.

16. The method of claim 15, further comprising determining if the first isolation pad should be replaced with the second isolation pad;

selectively coupling the second isolation pad to the pad carrier if it is determined that the first isolation pad should be replaced with the second isolation pad.

17. The method of claim 16 wherein determining if the first isolation pad should be replaced with the second isolation pad comprises:

monitoring the first isolation pad to determine if the first isolation pad is damaged; and determining that the first isolation pad should be replaced with the second isolation pad if the first isolation pad is damaged.

18. The method of claim 16, wherein determining if the first isolation pad should be replaced with the second isolation pad comprises:

identifying which of the first isolation pad and the second isolation pad matches a borehole size at the location of interest; and determining that the first isolation pad should be replaced if the second isolation pad matches the borehole size better than the first isolation pad.

19. The method of claim 15, wherein coupling the second isolation to the pad carrier comprises:

retracting the first isolation pad if the first isolation pad is in an extended position;

detaching the first isolation pad from the pad carrier;

translating the first isolation pad into a first guard cover;

translating the second isolation pad out of a second guard cover; and coupling the second isolation pad to the pad carrier, wherein the second isolation pad is extendable to substantially seal a probe of the formation tester against a wall of the wellbore.

20. The method of claim 19, wherein translating the first isolation pad into a guard cover comprises coupling a linear actuator adapter to the first isolation pad and moving the first isolation pad by activating the linear actuator adapter.

* * * * *